US007305790B2

(12) United States Patent
Kay

(10) Patent No.: US 7,305,790 B2
(45) **Date of Patent: *Dec. 11, 2007**

(54) REMOVABLE LIGHT ASSEMBLY OF PRE-DEFINED SHAPE FOR A WEAPON

(75) Inventor: Ira Kay, Warrenton, VA (US)

(73) Assignee: Quantum Leap Research Inc., Pointe-Claire, Quebec (CA)

( * ) Notice: Subject to any disclaimer, the term of this patent is extended or adjusted under 35 U.S.C. 154(b) by 126 days.

This patent is subject to a terminal disclaimer.

(21) Appl. No.: 10/814,584

(22) Filed: Apr. 1, 2004

(65) Prior Publication Data

US 2005/0246936 A1 Nov. 10, 2005

(51) Int. Cl.
*F41G 1/034* (2006.01)

(52) U.S. Cl. ..... 42/146; 42/114; 42/124; 42/117

(58) Field of Classification Search ..... 42/146, 42/114, 124, 117; 362/202
See application file for complete search history.

(56) References Cited

U.S. PATENT DOCUMENTS

| | | | |
|---|---|---|---|
| 2,580,246 | A | 9/1948 | Schall |
| 4,026,055 | A | 5/1977 | Weast |
| 4,429,468 | A | 2/1984 | Jimenez et al. |
| 4,501,071 | A | 2/1985 | Manske |
| 4,697,226 | A | 9/1987 | Verdin |
| 4,707,772 | A | 11/1987 | Jimenez et al. |
| 4,777,754 | A | 10/1988 | Reynolds, Jr. |
| 5,040,322 | A | 8/1991 | Iturrey, Jr. |
| 5,430,967 | A | 7/1995 | Woodman, III et al. |
| 5,471,777 | A | 12/1995 | McDonald |
| 5,555,662 | A | 9/1996 | Teetzel |
| 5,584,137 | A | 12/1996 | Teetzel |
| 5,727,346 | A | 3/1998 | Lazzarini et al. |
| 5,816,683 | A | 10/1998 | Christiansen |
| 5,822,905 | A | 10/1998 | Teetzel |
| 5,941,489 | A | 8/1999 | Fanelli et al. |
| 6,023,875 | A | 2/2000 | Fell et al. |
| 6,318,014 | B1 | 11/2001 | Porter |
| 6,438,888 | B1 * | 8/2002 | Lin et al. ..... 42/114 |
| 6,446,377 | B1 | 9/2002 | Hollenbach et al. |
| 6,499,247 | B1 | 12/2002 | Peterson |
| 6,565,226 | B1 | 5/2003 | Cummings |
| 6,574,901 | B1 | 6/2003 | Solinsky et al. |
| 2001/0027620 | A1 | 10/2001 | Wooten et al. |
| 2001/0045046 | A1 | 11/2001 | Otteman |

(Continued)

*Primary Examiner*—Teri Pham Luu
*Assistant Examiner*—John Davis Holman
(74) *Attorney, Agent, or Firm*—Scott A. Chambers; B. Dell Chism

(57) ABSTRACT

A light assembly having a pre-defined shape is provided to be removably attached to a guide provided on a weapon. The light assembly comprises a housing provided with a reflector having a lamp at one end thereof and batteries for powering the lamp through a switch. The housing has a pair of lateral members which are movable between a retracted position and an extended position so that, when the members are in the retracted position, the light assembly has the above-mentioned pre-defined shape and when the members are in the extended position, they are adapted to engage the guide. Means for preventing the longitudinal movement of the light assembly on the guide are also provided with the light assembly. The light assembly can thus be easily mounted and used as an aiming device with a weapon or be readily used as a separate and independent entity.

12 Claims, 10 Drawing Sheets

U.S. PATENT DOCUMENTS

2002/0007581 A1 1/2002 Bucciarelli et al.
2002/0100204 A1 8/2002 Kim
2005/0128741 A1* 6/2005 Matthews et al. ..... 362/206

* cited by examiner

REMOVABLE LIGHT ASSEMBLY OF PRE-DEFINED SHAPE FOR A WEAPON

FIELD OF THE INVENTION

The present invention relates, in general, to the field of aiming devices. More particularly, it concerns a light assembly of pre-defined shape, for removable attachment to a guide provided on a weapon.

BACKGROUND OF THE INVENTION

In the field of weapons, one major concern is proper aiming of the target of interest. In the prior art, there has been a number of aiming accessories, such as lasers, sites, flashlights or other accessories which can be mounted on firearms. Most of these accessories use various forms of locking screws, captive screws, nut and bolt clamps or other similar techniques to clamp the accessory to the weapon, as opposed to a latching mechanism which would safely lock the accessory to the weapon. Examples of such prior art accessories are given in U.S. Pat. or patent applications Nos. US 2001/0027620 A1; US 2001/0045046 A1; U.S. Pat. Nos. 5,555,662; 5,584,137; 5,941,489; and 6,565,226.

As can be appreciated, the just-mentioned aiming accessories present a number of caveats. Accordingly, such accessories can not be readily mounted on and detached from the weapon. In most cases, such mounting and detaching require the use of specific tools, or of both hands. Therefore, the weapon user can not simply grip the aiming device with one hand and readily mount it on his weapon in order to proceed to a precise triggering.

Other related prior art documents also present significantly different types of attachment methods to weapons or involve weapons that do not have a standard rail which can be interfaced with aiming accessories. Examples of such prior art accessories are given in U.S. Pat Nos. US 2002/0007581 A1; US 2002/0100204 A1; U.S. Pat. Nos. 4,707,772; 4,777,754; 5,040,322; 5,727,346; 5,816,683; 5,822,905; 6,318,014; and 6,574,901. The problem of such prior art devices is again the cumbersome mounting process as well as the bulkiness of such devices. More specifically, if the accessories can not be readily mounted on the weapon, they have to be provided with their specific mounting device thus decreasing the motility of the weapon user on site.

Also known in the prior art is a clamping mechanism for attaching an auxiliary apparatus to the frame of a weapon, which is further characterized in that the actual attachment or removal of the apparatus can be accomplished by a user with one hand, without using separate brackets or other mechanical components. These elements are disclosed in U.S. Pat. No. 5,430,967 (Woodman et al.).

It is thus apparent, from the above-mentioned prior art documents, there is a lack for an aiming device which can be readily mounted on a weapon and be readily used separately, as an independent light assembly.

SUMMARY OF THE INVENTION

An object of the present invention is to provide an aiming device, more particularly a light assembly, which satisfies the above-mentioned needs. More specifically, an object of the present invention is to provide a light assembly to be readily mounted on a weapon and be readily removed therefrom while resuming its original pre-defined shape, in order to be usable as a separate entity.

In accordance with the present invention, this object is achieved with a light assembly having a pre-defined shape, for removable attachment to a guide provided on a weapon. The light assembly comprises a housing, provided with a reflector having a lamp at one end thereof and batteries for powering the lamp through a switch. The housing of the light assembly has a pair of lateral members which can both be moved between a retracted position and an extended position. When the lateral members are in the retracted position, the light assembly has the above-mentioned pre-defined shape. When the lateral members are in the extended position, these members are adapted to engage the guide provided on the weapon. Preferably, each one of the lateral members is provided with a longitudinal groove which is shaped and sized to slidably engage a corresponding flange on the guide.

The housing of the light assembly of the present invention further has means for preventing longitudinal movement of the light assembly on the guide. According to a preferred embodiment of the present invention, the guide is provided with a plurality of cross-slots and each one of the lateral members further includes a latch having an upper portion and a lower portion. The upper portion and the lower portion of the latch each has an inner face adjacent to the side of the housing and an outer face. The latch also has a latch projection projecting inwardly from the inner face of the lower portion of the latch, for engaging any one of the above-mentioned cross-slots. The latch is pivotable between an operative and an inoperative position so that when the latch is in the operative position, it is normally inwardly biased, with the latch projection protruding into the side of the housing, thus providing the means for preventing longitudinal movement of the light assembly on the guide. When the latch is in the inoperative position, the upper portion is pivoted inwardly toward the housing while the lower portion is pivoted outwardly away from the housing, thereby preventing the latch projection from engaging the cross-slots.

According to further aspects, the present invention provides a method for removably attaching the light assembly as defined above, to a guide provided on a weapon.

The method for removably attaching the light assembly, as defined above, to a guide provided on a weapon comprises the steps of: a) providing a light assembly as described above; b) extending the lateral members until they are in the extended position; c) engaging the longitudinal grooves of the lateral members into the flanges of the guide; d) moving and maintaining the latches in their inoperative position, while sliding the light assembly on the guide; and e) moving the latches in their operative position.

Preferably, the method further comprises the following steps: f) moving and maintaining the latches in their inoperative position, while sliding the lateral members until they are in the retracted position; and g) moving the latches in their operative position, so that the light assembly resumes its pre-defined shape.

As can be appreciated, the light assembly according to the invention is very versatile, as it can be mounted on any known weapon guide while still being usable as a separate entity aside from the weapon and the guide.

These and other features, objects and advantages of the present invention will be better understood upon reading the following non-restrictive description of preferred embodiments thereof, made with reference to the accompanying drawings.

Figure 1A:
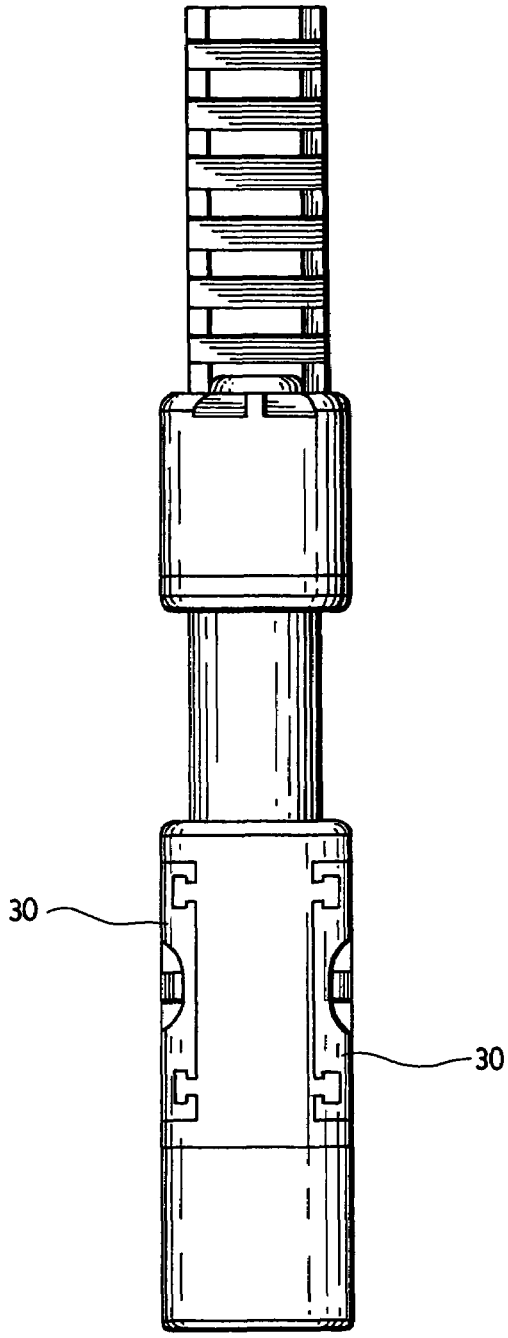
FIG. 1A is a top view of a light assembly mounted on a guide, according to a preferred embodiment of the invention.

While the invention will be described in conjunction with a preferred embodiment, it will be understood that it is not intended to limit the scope of the invention to such embodiment. On the contrary, it is intended to cover all alternatives, modifications and equivalents which may be included, as defined by the appended claims.

DESCRIPTION OF A PREFERRED EMBODIMENT

In the following description, similar features in the drawings have been given similar reference numerals and, in order to lighten the figures, some elements are not referred to in some figures if they were already identified in a previous figure.

As shown in FIGS. 1A to 1D, 2 and 3, a light assembly 10 according to a preferred embodiment of the present invention, having a pre-defined shape, is removably attachable to a guide 20 provided on a weapon. Any guide, preferably provided with parallel flanges 22 can be used to slidably engage the lateral members of the light assembly's housing. This allows any guide, such as a railing system, preferably an M1913 rail or any equivalent thereof, to engage a light assembly while being mounted on the weapon of interest.

The light assembly 10 comprises a housing, preferably with two sides. Each side of the housing of the light assembly 10 is provided with a pair of lateral members 30, preferably received by corresponding channels 40 provided on each side of the housing. Referring to FIG. 2, each channel 40 preferably comprises a back face 42 and inwardly sloping sidewalls 44 for maintaining the lateral member 30 within each channel 40. Alternatively and as shown in FIGS. 1A to 1D, the channel 40 can be substantially U-shaped and sized to receive a corresponding lateral member 30. This channel 40 is provided with guiding members 46 protruding outwardly and perpendicularly from the channel 40, preferably from the back face 42 thereof, for slidably engaging corresponding grooves 48 extending from the upper edge 34 to the lower edge 36 of the lateral members 30.

Figure 3:
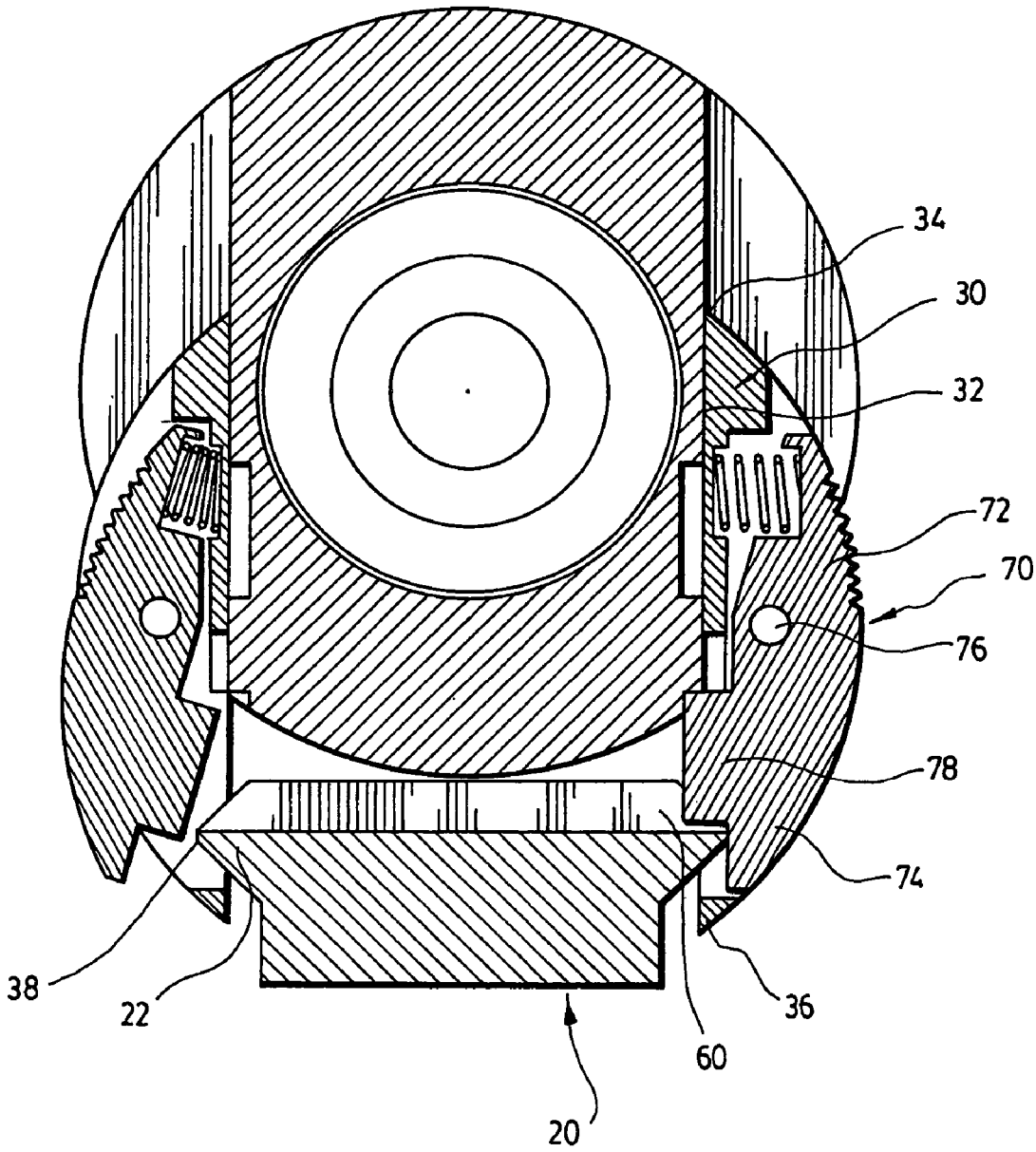
FIG. 3 is a cross-sectional view of the light assembly of FIG. 1C taken along line III-III.
Figure 5:
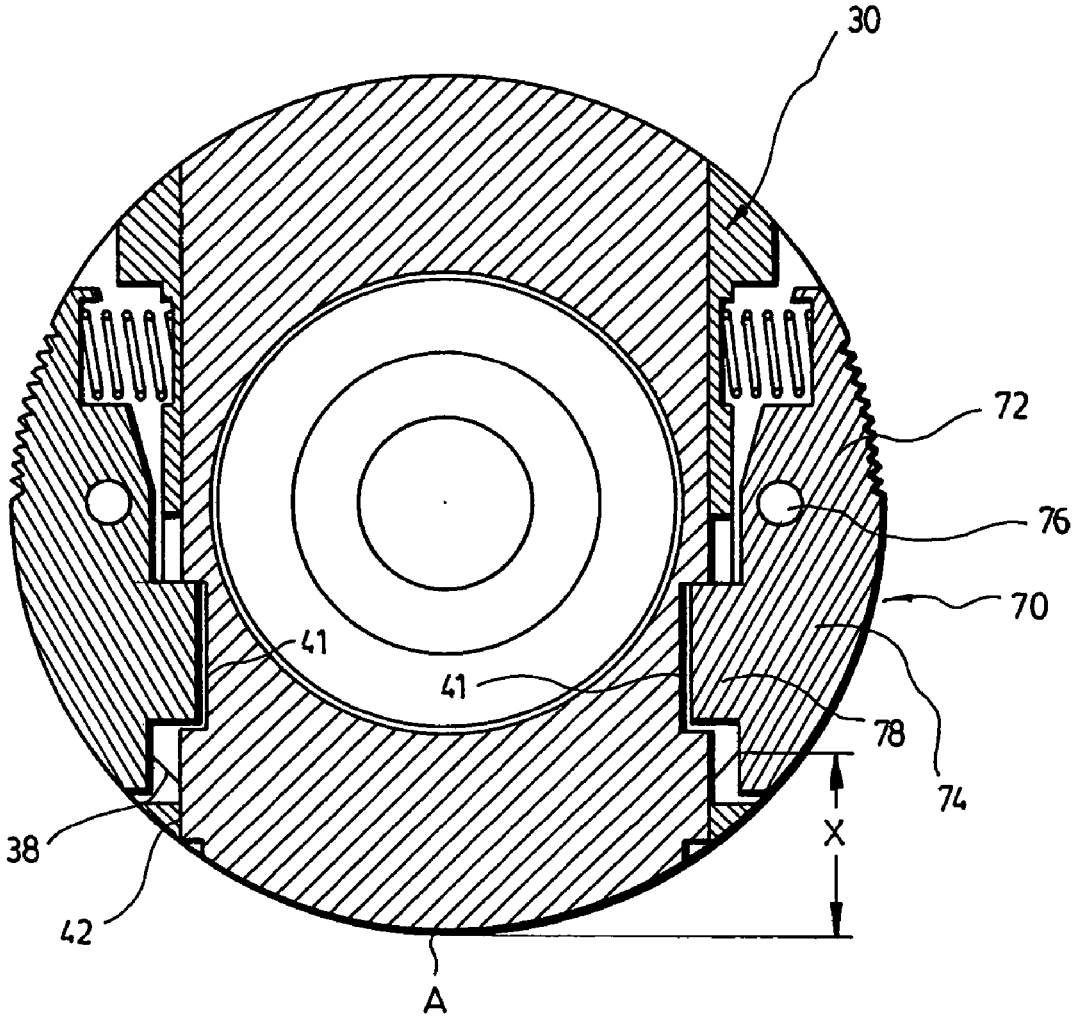
FIG. 5 is a cross-sectional view of the light assembly of FIG. 4C taken along line V-V.
Figure 6:
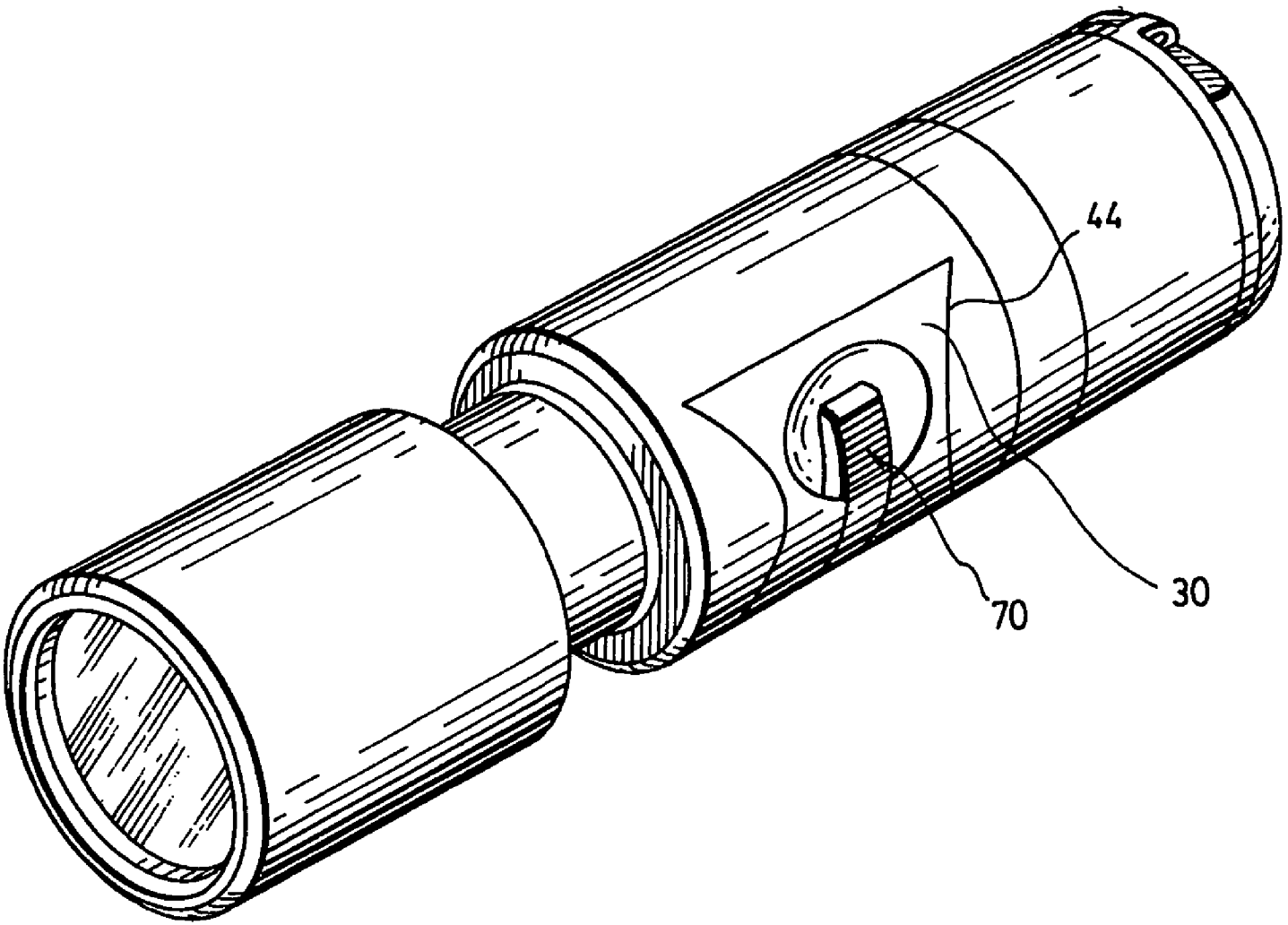
FIG. 6 is a front perspective view of the light assembly of FIG. 4C.

The lateral members 30 are movable between a retracted position, as shown in FIG. 5, and an extended position, as shown in FIG. 3, by a distance at least equal to distance x. Distance x is the distance between the longitudinal groove 38 and the lowest point A of the housing, as shown in FIG. 5.

In order for the lateral members 30 to remain in the retracted position, locking means are provided to lock the lateral members 30 in position. Similarly, locking means are provided to prevent the lateral members 30 from extending beyond the extended position.

When the lateral members 30 are locked in their retracted position, these lateral members 30 are adapted to engage the housing. Referring especially to FIG. 5, one can appreciate that each channel 40 comprises a back face 42 and sidewalls 44. The back face 42 of each channel comprises a depression 41 shaped and sized to receive a respective latch projection 78 so that, when the lateral members 30 are in the retracted position, each latch projection 78 engages a respective depression 41, thereby locking the lateral members 30 at distance x.

When the lateral members 30 are locked in their extended position, they are positioned so that the lowest point A of the housing is at least as close as possible to the guide 20 in order to allow the eventual sliding movement of the light assembly 10 on the guide 20. Referring more specifically to FIGS. 1 to 3, one can appreciate that each lateral member 30 comprises an inner substantially planar face 32 bounded at least by an upper edge 34 and a lower edge 36. The inner face 32 of the lateral members 30 is further characterized in that it is adjacent to the side of the housing and provided with a longitudinal groove 38 proximate and parallel to the lower edge 36. The longitudinal groove 38 is shaped and sized to slidably engage a corresponding flange 22 of the guide 20.

Preferably, the guide is provided with a plurality of cross-slots 60 and each lateral member 30 further includes a latch 70 with an upper portion 72 and a lower portion 74. Each one of the upper portion 72 and the lower portion 74 has an inner face, adjacent to the side of the housing, and an outer face.

Each latch further has a latch projection 78 projecting inwardly from the inner face of said lower portion 74 of the latch, for engaging any one of the cross-slots 60. Each latch 70 is further characterized in that it is preferably rotatable about a pivot 76 between an operative position (right side of FIG. 3) and an inoperative position (left side of FIG. 3).

As shown in FIG. 3 (right side), when the latch 70 is in the operative position, it is inwardly biased, with the latch projection 78, projecting inwardly from the inner face of the lower portion 74 of the latch and engaging a cross-slot 60, thereby providing the means for preventing longitudinal movement of the light assembly 10 on the guide 20.

Without departing from the scope of the present invention, it will be apparent for any person skilled in the art that the means for preventing longitudinal movement of the light assembly can comprise at least two, and preferably a plurality of projections protruding downwardly and outwardly from the area below the housing closest to the guide. Such projections would serve the same purpose as the latch projections 78 in their operative position (FIG. 3—right side).

Referring now to FIG. 3 (left side), one can appreciate that, when the latch 70 is in the inoperative position, the upper portion 72 is pivoted inwardly toward the housing while the lower portion 74 is pivoted outwardly away from the housing, thereby preventing the latch projection 78 from engaging any cross-slot 60. The retractable movement of the latch 70 is preferably initiated by a pressure, more preferably applied with fingers, on compressible and recoilable means such as springs or any equivalent thereof, provided in the upper portion 72 of the latch, for inwardly biasing the latch 70.

Referring to FIGS. 4A to 4D, 5 and 6, the housing is provided with a reflector 12 having a lamp 14 at one end thereof and batteries 16 for powering said lamp 14, such as a LED assembly, through a switch, such as a push button switch 19. The light assembly 10 is further characterized in that the reflector, the batteries and the switch, enclosed in the housing, pre-define the shape of the light assembly 10. By "pre-defined shape", it will be understood that the light assembly 10 has an advantageously uninterrupted profile when considered as a whole. More specifically, the uninterrupted profile of the light assembly 10 means that all the components of the housing have the same general shape, even though the reflector portion is larger than the battery portion which, in turn, is smaller than the switch portion of the housing. The light assembly 10 may advantageously have an ergonomic shape so that the user can comfortably grip it with one hand. The light assembly 10 may thus have a rectangular, oval or triangular shape, but preferably, a substantially cylindrical shape.

Figure 4A:
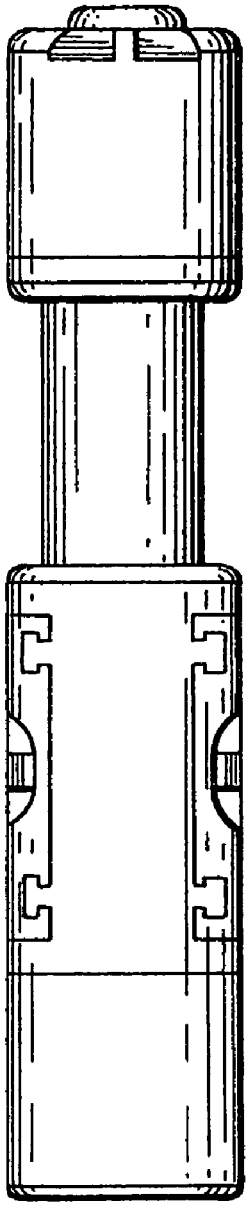
FIG. 4A is a top view of the light assembly of FIG. 1C, without the guide.
Figure 4B:
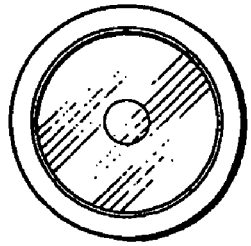
FIG. 4B is a front view of the light assembly of FIG. 4A.
Figure 4C:
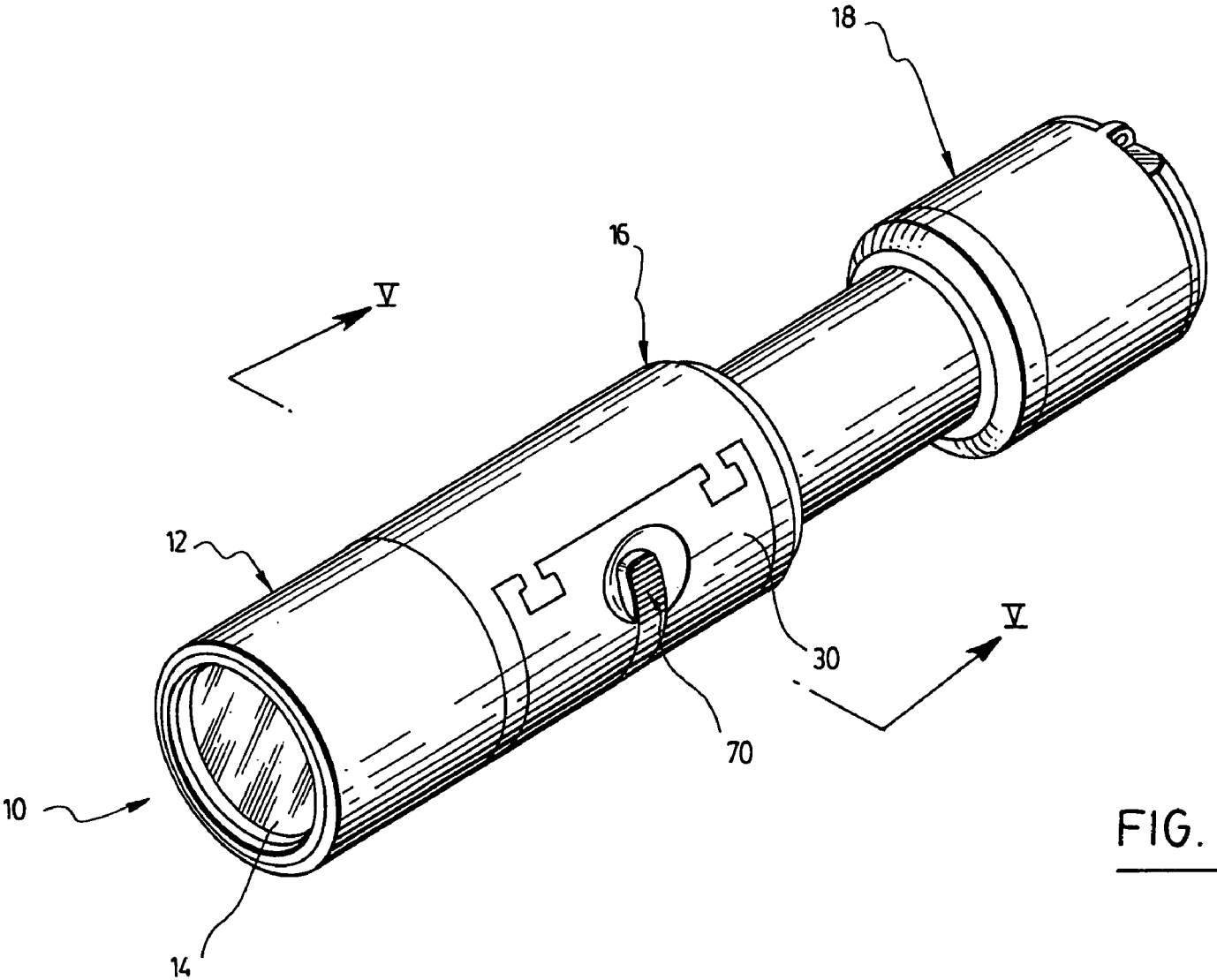
FIG. 4C is a front perspective view of the light assembly of FIG. 4A.
Figure 4D:
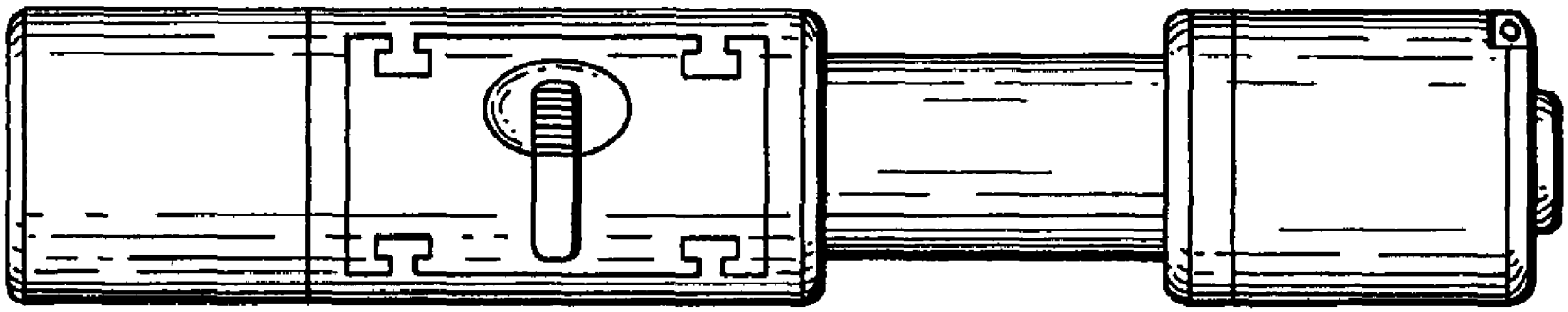
FIG. 4D is a side view of the light assembly of FIG. 4A.

As can also be appreciated from FIG. 4B, the uninterrupted profile of the light assembly is best depicted when the lateral members 30 are in the retracted position. More specifically, the outer face of both the upper and lower portions 72,74 of the latch, as well as the outer face of the lateral members, are shaped so that they form this uninterrupted profile with the rest of the housing.

Figure 1B:
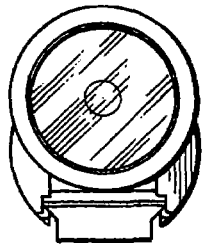
FIG. 1B is a front view of the light assembly of FIG. 1A.
Figure 1C:
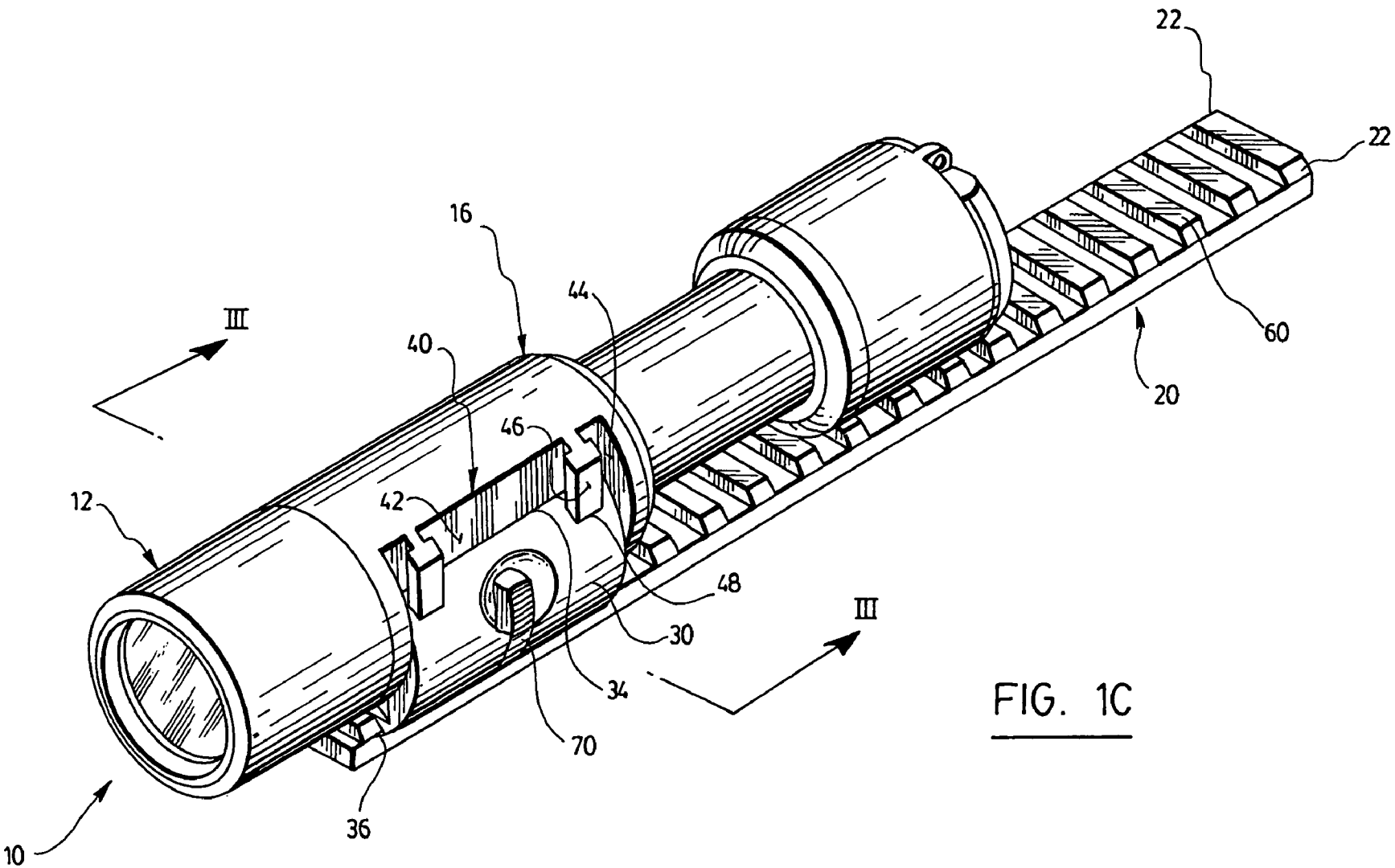
FIG. 1C is a front perspective view of the light assembly of FIG. 1A.
Figure 1D:
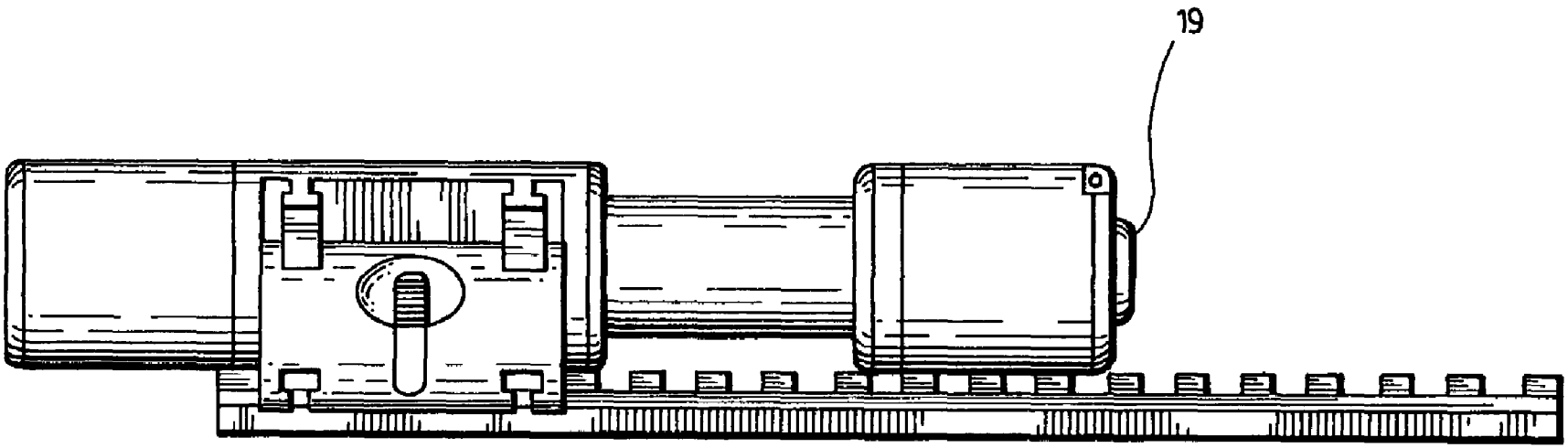
FIG. 1D is a side view of the light assembly of FIG. 1A.
Figure 2:
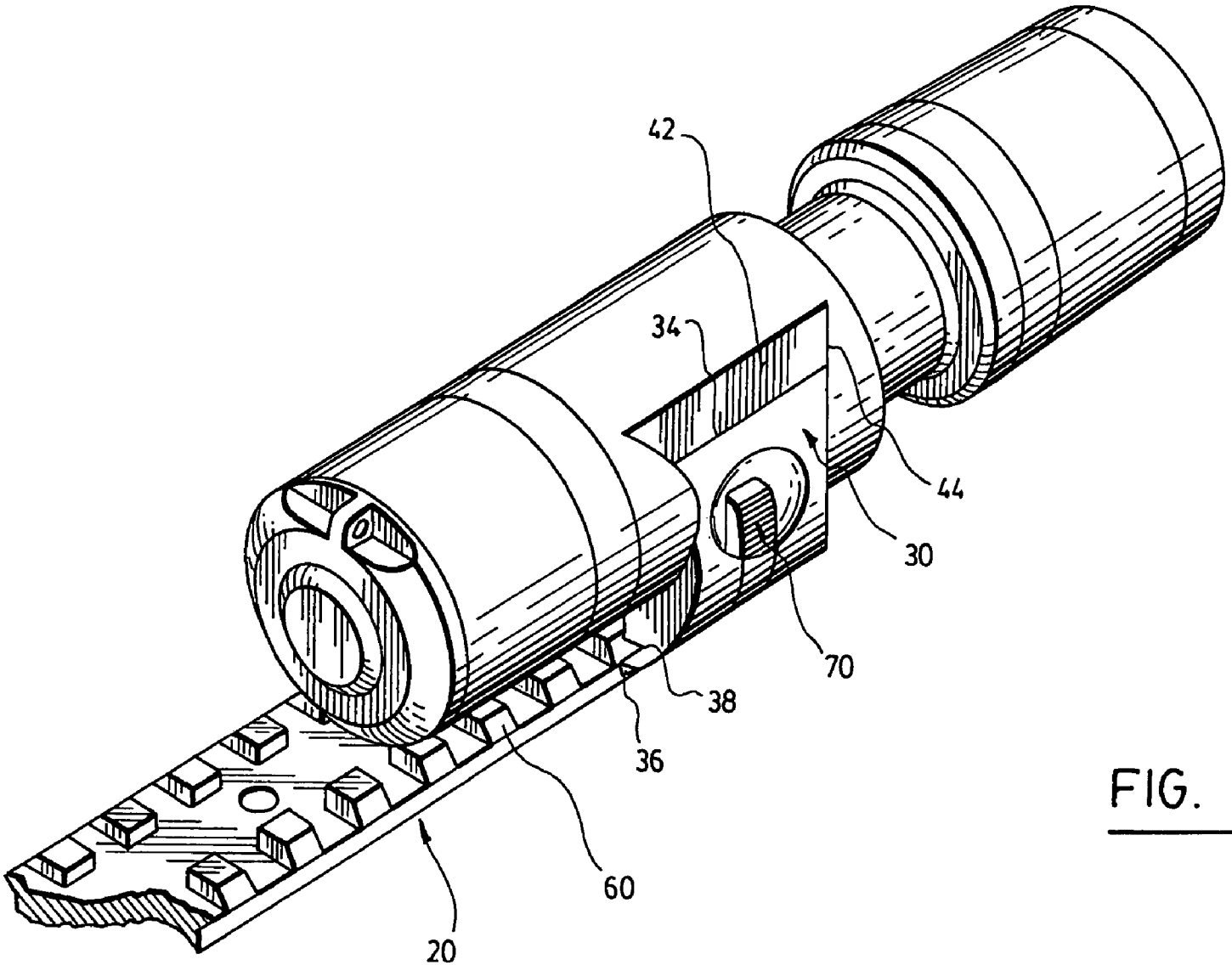
FIG. 2 is a rear perspective view of the light assembly of FIG. 1A.

Furthermore, the light assembly 10 may advantageously be of dimensions similar to the dimensions of the guide 20, as best shown in FIGS. 1A to 1C. More specifically, the width of the light assembly 10 is preferably somewhat similar to the width of the guide. As can be understood, the width of the light assembly and the guide is determined along the axis perpendicular to the main axis of each of these elements. It is thus clear that the present invention alleviates the need to use bulky light assemblies as aiming device accessories, which are not practical on site where vigilance, accuracy and rapidity are of the essence.

The present invention also provides a method for removably attaching the light assembly, as defined above, to a guide provided on a weapon comprises the steps of: a) providing a light assembly as described above; b) extending the lateral members until they are in the extended position; c) engaging the longitudinal grooves of the lateral members into the flanges of the guide; d) moving and maintaining the latches in their inoperative position, while sliding the light assembly on the guide; and e) moving the latches in their operative position.

Preferably, the method further comprises the following steps: f) moving and maintaining the latches in their inoperative position, while sliding the lateral members until they are in the retracted position; and g) moving the latches in their operative position so that the light assembly resumes its pre-defined shape.

Although preferred embodiments of the present invention have been described in detail herein and illustrated in the accompanying drawings, it is to be understood that the invention is not limited to these precise embodiments and that various changes and modifications may be effected therein without departing from the scope or spirit of the present invention.

The invention claimed is:

1. A light assembly, for removable attachment to a guide provided on a weapon, said light assembly comprising a housing provided with a reflector having a lamp at one end thereof and batteries for powering said lamp through a switch, said housing having:

a) a pair of lateral members movably mounted to the housing and being movable between a retracted position and an extended position relative to the housing, wherein:

when said members are in the retracted position, said lateral members are retracted into the housing; and when said members are in the extended position, said members protrude from the housing and are adapted to engage said guide; and b) means for preventing longitudinal movement of the light assembly on the guide.

2. The light assembly according to claim 1, wherein the switch is a push button.

3. The light assembly according to claim 1, wherein the light assembly has a substantially cylindrical shape upon retraction of the lateral members into the housing.

4. The light assembly according to claim 1, wherein the lamp is a LED assembly.

5. The light assembly according to claim 1, wherein the housing has two channels located on opposite sides of the housing for receiving a respective one of said lateral members, where each one of said lateral members comprises an inner substantially planar face bounded at least by an upper edge and a lower edge, and wherein the guide is planar, parallel to the housing and perpendicular to the inner planar face of the lateral members, said guide comprising flanges parallel to each other projecting outwardly, planar to the guide; said inner face of the lateral members being adjacent to the housing and provided with a longitudinal groove proximate and parallel to the lower edge, said longitudinal groove being shaped and sized to slidably engage the flange.

6. The light assembly according to claim 5, wherein the lateral members are further provided with locking means for locking said lateral members in the retracted position and in the extended position.

7. The light assembly according to claim 5, wherein each channel is shaped and sized to receive a corresponding lateral member, said channel comprising a back face and inwardly sloping sidewalls for maintaining the lateral member within said channel.

8. The light assembly according to claim 5, wherein each channel is substantially U-shaped and sized to receive a corresponding lateral member, said U-shaped channel being provided with guiding members protruding outwardly and perpendicularly from said channel, for slidably engaging corresponding grooves extending from the upper edge to the lower edge of the lateral members.

9. The light assembly according to claim 5, wherein the guide is provided with a plurality of cross-slots and wherein each one of said lateral members further includes a latch having:

an upper portion and a lower portion, said upper portion and said lower portion each having an inner face adjacent to the side of the housing and an outer face; and a latch projection projecting inwardly from the inner face of said lower portion of the latch, for engaging any one of said cross-slots, said latch being inwardly biased;

wherein the latch is pivotable between an operative position and an inoperative position so that:

a - when the latch is in the operative position, with the latch projection protruding into the cross-slots of the guide, thereby providing the means for preventing longitudinal movement of the light assembly on the guide; and b - when the latch is in the inoperative position, the upper portion is pivoted inwardly toward the housing while the lower portion is pivoted outwardly away from the housing, thereby preventing the latch projection from engaging any one of said cross-slots.

10. The light assembly according to claim 9, wherein each channel comprises a back face and sidewalls, said back face comprising a depression shaped and sized to receive a respective one of said latch projections so that, when the lateral members are in the retracted position, each one of said respective latch projections engages said respective depression.

11. A method for removably attaching a light assembly, said light assembly, for removable attachment to a guide provided on a weapon, said light assembly comprising a housing provided with a reflector having a lamp at one end thereof and batteries for powering said lamp through a switch, said housing having a pair of lateral members movably mounted to the housing and being movable between a retracted position into the housing and an extended position protruding from the housing and means for preventing longitudinal movement of the light assembly on the guide, said method comprising the steps of:

a) providing said light assembly;

b) extending the lateral members by sliding them in channels from the retracted position in the housing, until they are in the extended position outside of the housing adapted to engage the guide;

c) engaging longitudinal grooves of the lateral members into flanges of the guide;

d) moving and maintaining latches of the lateral members in an inoperative position, while sliding the light assembly on the guide; and e) moving the latches in an operative position to engage the guide.

12. The method of claim 11 further comprising the step of detaching the light assembly from the guide, said step of detaching comprising the sub-steps of:

f) moving and maintaining the latches in the inoperative position, while sliding the light assembly longitudinally along the flanges of the guide; and g) depressing the latches, so that the members slide back in the channels back into the light assembly.

* * * * *